US009897064B2

(12) United States Patent
Deguchi

(10) Patent No.: US 9,897,064 B2
(45) Date of Patent: Feb. 20, 2018

(54) IGNITION COIL FOR INTERNAL COMBUSTION ENGINE

(71) Applicant: DENSO CORPORATION, Kariya, Aichi-pref. (JP)

(72) Inventor: Masataka Deguchi, Chiryu (JP)

(73) Assignee: DENSO CORPORATION, Kariya (JP)

( * ) Notice: Subject to any disclaimer, the term of this patent is extended or adjusted under 35 U.S.C. 154(b) by 218 days.

(21) Appl. No.: 13/864,793

(22) Filed: Apr. 17, 2013

(65) Prior Publication Data

US 2013/0284157 A1 Oct. 31, 2013

(30) Foreign Application Priority Data

Apr. 26, 2012 (JP) ..... 2012-101260

(51) Int. Cl.

| | |
|---|---|
| ***F02P 23/00*** | (2006.01) |
| ***F02P 3/02*** | (2006.01) |
| ***H01F 38/12*** | (2006.01) |
| ***H01F 27/29*** | (2006.01) |

(52) U.S. Cl.

CPC ..... *F02P 23/00* (2013.01); *F02P 3/02* (2013.01); *H01F 27/29* (2013.01); *H01F 38/12* (2013.01)

(58) Field of Classification Search

CPC .. H01F 38/12; H01F 2038/122; H01F 27/022; H01F 27/327; H01F 27/29; F02P 3/02; F02P 23/00

USPC ..... 123/634

See application file for complete search history.

(56) References Cited

U.S. PATENT DOCUMENTS

| | | | | |
|---|---|---|---|---|
| 5,487,676 A * | 1/1996 | Maruyama | F02P 3/02 324/399 |
| 6,231,394 B1 | 5/2001 | Schnell et al. | |
| 6,332,458 B1 * | 12/2001 | Shimada | H01T 13/44 123/634 |

(Continued)

FOREIGN PATENT DOCUMENTS

| | | |
|---|---|---|
| JP | U-64-024816 | 2/1989 |
| JP | A-2000-036349 | 2/2000 |

(Continued)

OTHER PUBLICATIONS

Jul. 7, 2015 Office Action issued in Japanese Application No. 2012-101260 (with translation).

*Primary Examiner* — Sizo Vilakazi

(74) *Attorney, Agent, or Firm* — Nixon & Vanderhye P.C.

(57) ABSTRACT

An ignition coil for an internal combustion engine is provided which is equipped with a high-voltage connector terminal and a high-voltage output terminal. The high-voltage connector terminal is connected to a secondary coil. The high-voltage output terminal is to be joined to a spark plug. The high-voltage connector terminal has a tip portion with a rounded surface which elastically establishes an electrical contact with the surface of the high-voltage output terminal. The rounded surface serves to minimize the wear of the high-voltage connector terminal and the high-voltage output terminal which arises from rubbing therebetween during assembling or operation of the ignition coil, thus avoiding the adhesion of foreign objects to the contact surfaces and ensuring the stability of electric communication between the high-voltage connector terminal and the high-voltage output terminal.

8 Claims, 5 Drawing Sheets

(56) References Cited

U.S. PATENT DOCUMENTS

| | | | | |
|---|---|---|---|---|
| 6,747,540 | B1 * | 6/2004 | Nakase | H01F 38/12 336/107 |
| 2001/0049231 | A1 | 12/2001 | Bricaud | |
| 2005/0208826 | A1 | 9/2005 | Suzuki | |
| 2009/0033451 | A1 * | 2/2009 | Akimoto | H01F 38/12 336/96 |
| 2009/0071454 | A1 * | 3/2009 | Fujiyama | H01F 38/12 123/621 |
| 2012/0299679 | A1 * | 11/2012 | Kobayashi | H01F 38/12 336/90 |

FOREIGN PATENT DOCUMENTS

| | | |
|---|---|---|
| JP | A-2002-042933 | 2/2002 |
| JP | A-2005-260024 | 9/2005 |
| JP | A-2005-268067 | 9/2005 |
| JP | 3773486 | 2/2006 |

* cited by examiner

IGNITION COIL FOR INTERNAL COMBUSTION ENGINE

CROSS REFERENCE TO RELATED DOCUMENT

The present application claims the benefit of priority of Japanese Patent Application No. 2012-101260 filed on Apr. 26, 2012, the disclosure of which is totally incorporated herein by reference.

BACKGROUND OF THE INVENTION

1. Technical Field

This disclosure relates generally to an ignition coil working to produce an electric spark in a spark plug for use in internal combustion engines.

2. Background Art

Typical ignition coils for spark plugs installed in internal combustion engines are equipped with a high-voltage connector terminal which connects at an end thereof with a trailing end of a winding of a secondary coil and is placed in elastic abutment with a high-voltage output terminal disposed in a lower portion of a holder casing. An electric circuit, which extends from the trailing end of the secondary coil, to the high-voltage connector terminal, to the high-voltage output terminal, and to the spark plug, works to apply the high voltage to the spark plug.

Japanese Patent First Publication No. 2004-207582 discloses the above types of high-voltage connector terminal and high-voltage output terminal of the ignition coil. In order to ensure the stability in elastic contact between the high-voltage connector terminal and the high-voltage output terminal, the high-voltage output terminal has irregularities formed on an end surface thereof. Specifically, the irregularities increase an area of contact between the high-voltage connector terminal and the high-voltage output terminal to enhance the stability in elastic contact therebetween.

The above structure of the high-voltage output terminal, however, faces the drawback in that rubbing of the high-voltage connect terminal against the irregularities on the high-voltage output terminal facilitate ease of wear of the irregularities, which may lead to adhesion of foreign objects thereto, that is, contamination of surfaces of contact between the high-voltage connector terminal and the high-voltage output terminal. Such contamination results in instability of electric contact between the high-voltage connector terminal and the high-voltage output terminal and also accelerates the wear of them. The foreign objects may also be adhered to the secondary coil, thus resulting in a decrease in resistance thereof to voltage and degradation in reliability of operation of the ignition coil. Further, when the high-voltage connector terminal is disposed at an inclined orientation on the high-voltage output terminal during assembling processes of the ignition coil, it may cause the top of the high-voltage connector terminal to get stuck to the surface of the high-voltage output terminal, so that the high-voltage connector terminal may deform, which leads to damage to a bobbin of the secondary coil by which the high-voltage connector terminal is retained or lack in pressure required to ensure the stability in contact between the high-voltage connector terminal and the high-voltage output terminal.

SUMMARY

It is therefore an object to provide an improved structure of an ignition coil for use in an internal combustion engine which is designed to minimize the contamination of a high-voltage connector terminal and ensure stability in contact between the high-voltage connector and a high-voltage output terminal.

According to one aspect of an embodiment, there is provided an ignition coil for an internal combustion engine which comprises: (a) a coil unit equipped with a primary coil, a secondary coil which works to develop a high voltage as a function of an electric current flowing in the primary coil, and a high-voltage connector terminal which electrically connects with the secondary coil and is elastically deformable; (b) a high-voltage output terminal placed in contact with the high-voltage connector terminal for applying the high voltage, as developed by the secondary coil, to a spark plug installed in an internal combustion engine; (c) a holder casing in which the coil unit is disposed, the holder casing having a portion of the high-voltage output terminal exposed externally; and (d) a resinous insulator disposed in the holder casing to cover and fix the coil unit within the holder casing.

The high-voltage connector terminal has a first end and a second end opposite the first end, the high-voltage connector terminal including a connecting portion end which electrically connects at the first end with the secondary coil, a tip portion which is placed at the second end in contact with the high-voltage output terminal, and an arm portion which connects the connecting portion and the tip portion together. The tip portion has a rounded surface which is placed in contact with the high-voltage output terminal.

The rounded surface of the tip portion minimizes the wear of surfaces of contact between the high-voltage connector terminal and the high-voltage output terminal which arises from the rubbing therebetween, thus avoiding the adhesion of foreign objects to the contact surfaces. In other words, the tip portion of the high-voltage connector terminal does not have irregularities, that is, has a curved even surface to be placed in contact with the high-voltage output terminal, thus not exerting uneven pressure on the high-voltage connector terminal in a radial direction of the high-voltage output terminal and ensuring the stability in pressure required to achieve electric contact between the high-voltage connector terminal and the high-voltage output terminal.

The minimization of the adhesion of foreign objects to the surfaces of contact between the high-voltage connector terminal and the high-voltage output terminal avoids unwanted development of sparks upon application of high voltage to the spark plug.

Further, when the high-voltage connector terminal is disposed at an inclined orientation on the high-voltage output terminal during assembling processes of the ignition coil, the structure of the ignition coil does not cause the tip portion of the high-voltage connector terminal to get stuck with the surface of the high-voltage output terminal and avoids exertion of uneven load on the high-voltage connector terminal which would lead to undesired deformation thereof.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 6(*b*) is a side view of FIG. 6(*a*);

FIG. 7(*b*) is a side view of FIG. 7(*a*);

FIG. 8(*b*) is a partially sectional view which illustrates the high-voltage connector terminal and the high-voltage output terminal of FIG. 8(*a*) before they are placed in contact with each other.

DESCRIPTION OF THE PREFERRED EMBODIMENTS

Figure 1:
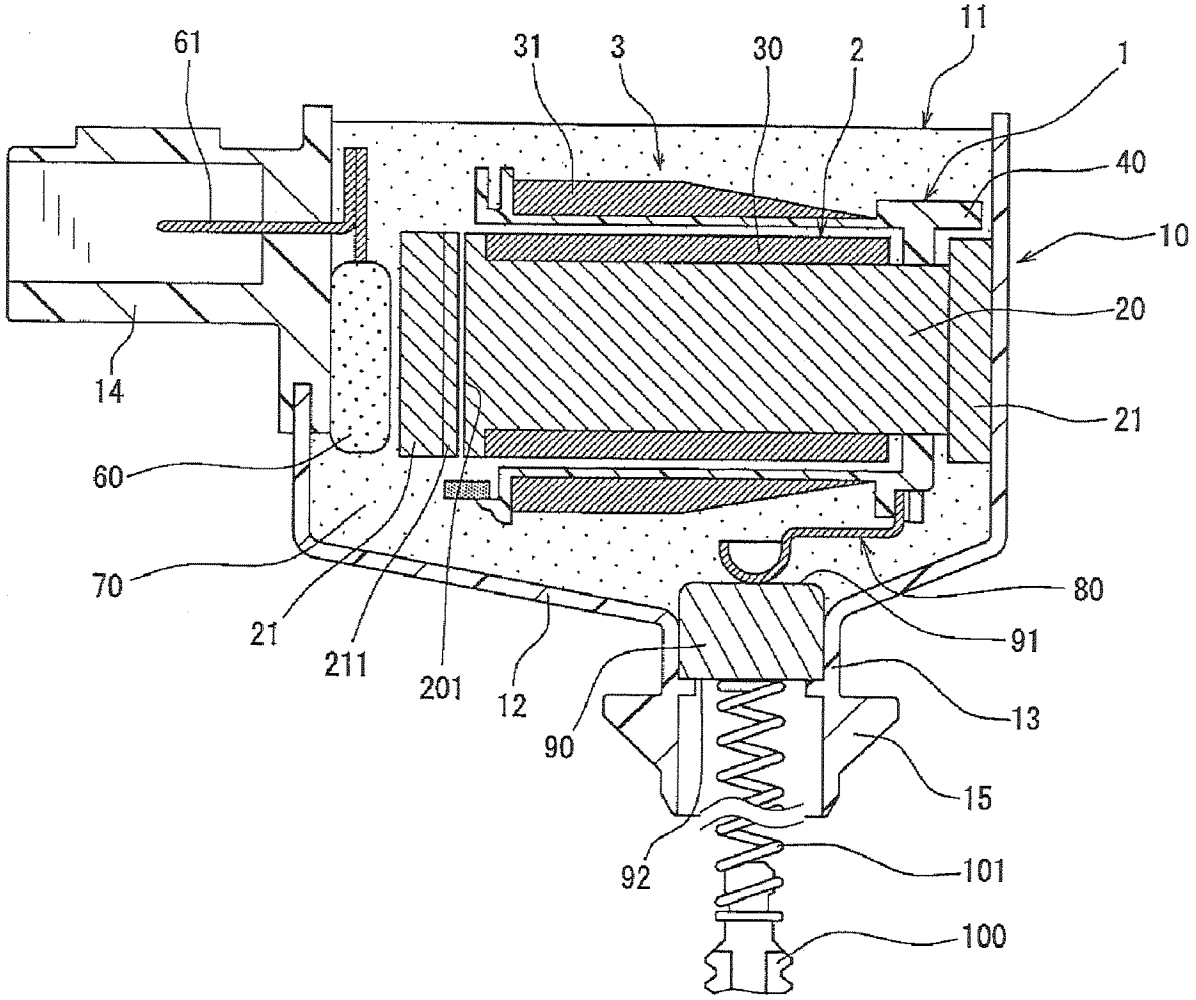
FIG. 1 is a longitudinal sectional view which illustrates an ignition coil of the first embodiment.

Referring to the drawings, wherein like reference numbers refer to like parts in several views, particularly to FIG. 1, there is shown an ignition coil equipped with a high-voltage connector terminal 80 according to the first embodiment. The ignition coil is electrically connected to a spark plug 100 mounted in an internal combustion engine.

The ignition coil also includes a holder casing 10, a coil unit 1, a high-voltage output terminal 90, and a resinous insulator 70. The holder casing 10 is made of resin and has a greater opening and a smaller opening. The greater opening is formed in one of opposed ends of the holder casing 10 (i.e., an upper end, as viewed in FIG. 1). The smaller opening is formed in the other end of the holder casing 10. The coil unit 1 is disposed inside the holder casing 10. The coil unit 1 consists essentially of a center core 20, a primary coil 2, a secondary coil 3, an outer core 21, the high-voltage connector terminal 80, and an igniter 60. The high-voltage output terminal 90 is connected electrically to the spark plug 100 through a conductor 101. The coil unit 1 is covered with the resinous insulator 70 and fixed by the resinous insulator 70 firmly within the holder casing 10. The primary coil 2 of the coil unit 1 is supplied with electric current from an external power source. The igniter 60 controls the current to be fed to the primary coil 2 to develop a high-voltage at the secondary coil 3. The high-voltage at the secondary coil 3 is then applied to the high-voltage output terminal 90 through the high-voltage connector terminal 80 and to the spark plug 100 through the high-voltage output terminal 90 and the conductor 101.

The coil unit 1 is, as described above, equipped with the primary coil 2, the secondary coil 3, the center core 20, the outer core 21, and the high-voltage connector terminal 80. The primary coil 2 is made of a primary winding 30 wound around the center core 20. The secondary coil 3 is made of a secondary winding 31 wound around a bobbin 40 and disposed around the outer periphery of the primary coil 2. The center core 20, the primary coil 2 and the secondary coil 3 are installed within the outer core 21. The high-voltage connector terminal 80 is connected electrically to a trailing portion of the secondary winding 31 of the secondary coil 3. The trailing portion of the secondary winding 31 is a portion thereof which has been wound last around the bobbin 40.

The center core 20 is of a substantially hollow cylindrical shape and made by pressing soft magnetic powder consisting of, for example, iron, cobalt, and/or nickel. The primary winding 30 is electric wire which is made by baking insulating paint on conductive material such as copper.

The bobbin 40 is made of a resinous hollow cylinder. The secondary winding 31 is electric wire which is made by baking insulating paint on conductive material such as copper. The secondary coil 3 is disposed around the outer periphery of the primary coil 2 coaxially therewith. The secondary winding 31 of the secondary coil 3 is different in diameter of wire from the primary winding 30 of the primary coil 2. Specifically, the diameter of the secondary winding 31 is smaller than that of the primary winding 30. The number of turns of the secondary winding 31 is greater than that of the primary winding 30.

The outer core 21 serves to form a magnetic circuit along with the center core 20. The outer core 21 is of a substantially hollow cubic or rectangular prism shape made by pressing soft magnetic powder. The outer core 21 is a rectangular cuboid with an axis which extends perpendicular to the length or axis of the center core 20 and passes through an upper opening 11 and a bottom 12 of the holder casing 10. FIG. 1 illustrates only two of four side faces of the outer core 21 which face each other in the axial direction of the center core 20 for the brevity of illustration. One of such two faces of the outer core 21 is, as clearly illustrated in FIG. 1, placed in contact with the inner surface of the center core 20, while the other face is placed away from the inner surface of the center core 20 through an air gap. With the air gap, a permanent magnet 211 is disposed so as to face an axial end face 201 of the center core 20 in order to enhance magnetic properties of the coil unit 1.

The high-voltage connector terminal 80 is formed by elastically deformable conductor made of, for example, phosphor bronze in the form of a plate. The high-voltage connector terminal 80 is fit or retained in the bobbin 40 of the coil unit 1 and connects electrically with the secondary coil 3. The use of phosphor bronze facilitates ease with which the high-voltage connector terminal 80 is welded to the secondary winding 31 and also increases the strength of such a weld.

Figure 2:
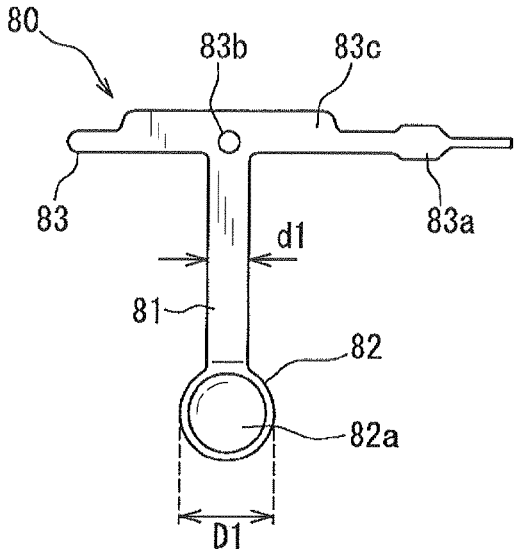
FIG. 2 is a plan view which illustrates a high-voltage connector terminal disposed in the ignition coil of FIG. 1.

FIG. 2 illustrates the high-voltage connector terminal 80 before installed in the coil unit 1. The high-voltage connector terminal 80 is of a substantially T-shape and includes a connecting portion 83 which is to be joined electrically to the secondary coil 3, a tip portion 82 which is to be placed in electric contact with the high-voltage output terminal 90 and an arm portion 81 which is in the form of a plate and connects between the tip portion 82 and the connecting portion 83. The tip portion 82 has a spherical surface to be placed in contact with the high-voltage output terminal 90. Specifically, the tip portion 82 includes a hollow hemispherical head 82*a* which bulges toward the high-voltage output terminal 90 to have a bowl-shaped recess facing away from the high-voltage output terminal 90. The maximum outer diameter D1 of the hemispherical head 82*a* is greater than the width d1 of the arm portion 81. The width d1 is a dimension of the arm portion 81 in a direction perpendicular to the length-wise direction and the thickness-wise direction of the arm portion 81.

Figure 3:
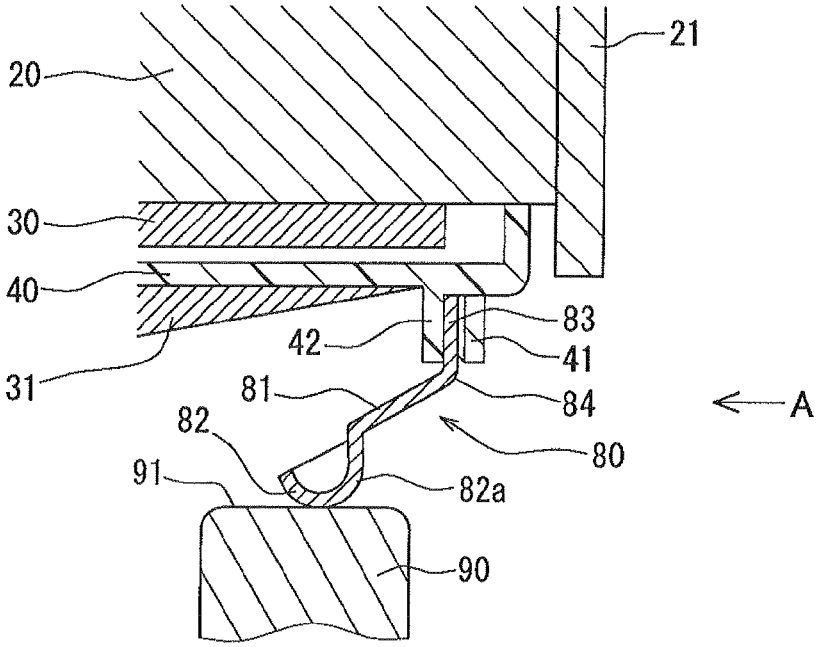
FIG. 3 is a partially enlarged longitudinal sectional view which illustrates an electric and elastic contact between a high-voltage connector terminal and a high-voltage output terminal in the ignition coil of FIG. 1.

The connecting portion 83 includes a holder portion 83*b*, a wire-winding portion 83*a*, and a connecting arm portion 83*c*. The holder portion 83*b* is fit in the bobbin 40 to retain or hold the high-voltage connector terminal 80 on the bobbin 40. The wire-winding portion 83*a* has the secondary winding 31 wound thereon to establish an electric joint between the high-voltage connector terminal 80 and the secondary coil 31. The connecting arm portion 83*c* extends perpendicular to the arm portion 81. Specifically, the holder portion 83*b* has a hole formed therein. The bobbin 40 has a protrusion such as a pin. The protrusion of the bobbin 40 is fit in the hole of the holder portion 83*b*, thereby retaining the high-voltage connector terminal 80 on the bobbin 40. Additionally, the connecting arm portion 83*c* is, as illustrated in FIG. 3, grasped firmly by a first bobbin fixing portion 41 and a second bobbin fixing portion 42 shown in FIG. 4 to secure the high-voltage connector terminal 80 to the bobbin 40.

The resinous insulator 70 is made of thermosetting resin such as epoxy resin. The formation of the resinous insulator 70 is achieved by pouring the thermosetting resin into the holder casing 10 from the upper opening 11 so as to cover or electrically insulate components such as the coil unit 1, etc. completely without any air gap then heating it to fix the components within the holder casing 10.

The holder casing 10 is substantially cuboid made of a thermoplastic resin such as polybutylene therephthalate (PBT). The holder casing 10 also includes a plug shell 14, a bottom 12, and the upper opening 11 facing the bottom 12 in a vertical direction of the holder casing 10. The bottom 12 has a hollow cylindrical lower extension 13 facing downwardly, as viewed in FIG. 1. The plug shell 14 has disposed therein a plurality of plug terminals 61 and serves as a pin connector. The plug terminals 61 are made of pins and extend within the plug shell 14. The plug terminals 61 are to be connected to an external connector to achieve an electric joint of the coil unit 1 to an ignition control device and a power supply. In the lower extension 13 of the bottom 12 of the holder casing 10, the high-voltage output terminal 90 is fit in electric contact with the high-voltage connector terminal 80. The lower extension 13 has formed on an outer periphery thereof a barbed protrusion 15 which achieves a snap-fit joint to an elastic cylinder (e.g., a plug cap) of the spark plug 100.

The high-voltage output terminal 90 is plugged into the lower extension 13 in order to avoid the entrance of the thermosetting resin into the extension 13 when it is put in the holder casing 10 to form the resinous insulator 70. Specifically, the high-voltage output terminal 90 partially protrudes inside the holder casing 10 toward the upper opening 11, so that the upper end surface 91 and a portion of a peripheral side surface thereof are covered with the resinous insulator 70, while the lower end surface 92 is exposed to the atmosphere within the lower extension 13.

The high-voltage output terminal 90 connects electrically at the lower end surface 92 with the spark plug 100 through a spiral conductor 101. The spiral conductor 101 is made of metal and wound at an end thereof on the spark plug 100 and placed at the other end in abutment with the lower end surface 92 of the high-voltage output terminal 90. The high-voltage output terminal 90 works to apply high-voltage, as created by the ignition coil, to the spark plug 100.

The igniter 60 is coupled electrically with the ignition control device of an external engine control system (not shown) through the plug terminals 61. The igniter 60 works to control the application of electric current, as delivered from the power supply, to the primary coil 2 in response to an ignition signal outputted from the ignition control device. The igniter 60 includes a circuit board on which switching devices, such as insulated gate bipolar transistors, are fabricated and which is disposed within an insulating resin-made mold.

The operation and beneficial effects of the high-voltage connector terminal 80 of the ignition coil will be described below.

In the assembling process of the ignition coil, when the coil unit 1 is put into the holder casing 10 from the upper opening 11, the tip portion 82 of the high-voltage connector terminal 80 first makes contact with the high-voltage output terminal 90. In the initial stage where the tip portion 82 is just placed on the upper end surface 91 of the high-voltage output terminal 90, the high-voltage connector terminal 80 does not yet deform elastically and contacts at the hemispherical head 82*a* of the tip portion 82 with a portion of the upper end surface 91 of the high-voltage output terminal 90 which is out of alignment with the longitudinal center line (i.e., the axis) of the high-voltage output terminal 90. The initial stage is when the hemispherical head 82*a* of the high-voltage output terminal 80 makes contact with the upper end surface 91 of the high-voltage output terminal 90 before pressing the upper end surface 91.

Subsequently, when the coil unit 1 is put more deeply in the holder casing 10, pressure is exerted on both the high-voltage connector terminal 80 and the high-voltage output terminal 90 in the longitudinal direction of the high-voltage output terminal 90. This will cause the joint 84 between the arm portion 81 and the connecting portion 83 to be, as can be seen in FIG. 1, bent so that the arm portion 81 is laid substantially parallel to the upper end surface 91 of the high-voltage output terminal 90. During the bending of the joint 84, the hemispherical head 82*a* of the tip portion 82 of the high-voltage connector terminal 80 is subjected to pressure in the longitudinal direction of the high-voltage output terminal 90 (i.e., a direction perpendicular to the length of the center core 20) and slides on the upper end surface 91 toward the center of the upper end surface 91 while exerting almost no pressure on the upper end surface 91 in a radial direction thereof. This minimizes the wear of the tip end portion 82 and the upper end surface 91 due to physical friction therebetween, thus avoiding the adhesion of foreign objects to the hemispherical head 82*a* or the upper end surface 91.

The entry of foreign objects into between the high-voltage connector terminal 80 and the high-voltage output terminal 90 will result in a drop in resistance of, for example, the secondary coil 3 to voltage due to the adhesion of the foreign objects thereto and the wear of the high-voltage connector terminal 80 and the high-voltage output terminal 90 as well as the instability of contact between the high-voltage connector terminal 80 and the high-voltage output terminal 90. The wear of the terminals may break the electrical communication between the high-voltage connector terminal 80 and the high-voltage output terminal 90, which results in a failure in operation of the ignition coil and a drop in reliability thereof.

Figure 4:
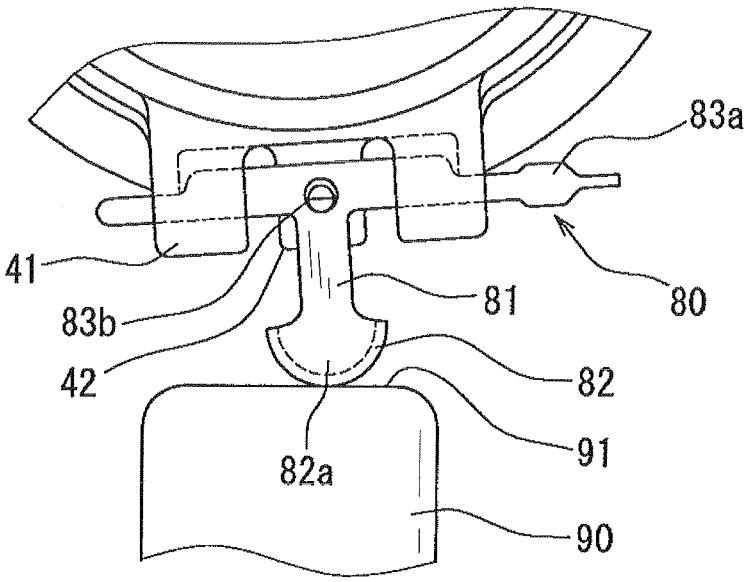
FIG. 4 is a partially side view, as viewed from an arrow A in FIG. 3, which illustrates the case where a coil unit is disposed at an inclined orientation in a holder casing.

FIG. 4 is an illustration of the coil unit 1 and the high-voltage output terminal 90, as viewed from an arrow A in FIG. 3, in the case where the high-voltage connector terminal 80 is put in the holder casing 10 at an inclined orientation due to a variation in dimension of the components of the ignition coil or an error in assembling thereof. When the coil unit 1 is put deeply in the holder casing 10 after the high-voltage connector terminal 80 touches the upper end surface 91 of the high-voltage output terminal 90, it will result in concern that the tip portion 82 may get stuck with the upper end surface 91, thus causing the high-voltage connector terminal 80 to experience uneven pressure, so that it deforms undesirably, which leads to damage to the bobbin 40 or lack in pressure required to ensure the stability in contact between the high-voltage connector terminal 80 and the high-voltage output terminal 90. However, the hemispherical head 82*a* of the high-voltage connector terminal 80 has a rounded or domed surface, thus establishing smooth sliding of the tip portion 82 of the high-voltage connector terminal 80 on the upper end surface 91 of the high-voltage output terminal 90 and ensuring the stability in contact between the tip portion 82 and the upper end surface 91.

The maximum outer diameter D1 of the hemispherical head 82*a* of the high-voltage connector terminal 80 is, as descried above, set greater than the width d1 of the arm portion 81. This causes the hemispherical head 82*a* to touch the upper end surface 91 of the high-voltage output terminal 90 earlier than when either of side edges of the arm portion 81 touches the high-voltage output terminal 90 in the case where the coil unit 1 is disposed in the holder casing 10 at an inclined orientation, thus ensuring the stability of contact between the high-voltage connector terminal 80 and the high-voltage output terminal 90 and reliability in operation of the ignition coil.

The hemispherical head 82*a* of the high-voltage connector terminal 80, as described above, has the bowl-shaped recess or cavity facing in a direction opposite the high-voltage output terminal 90. In other words, the hemispherical head 82*a* is of a cup-shape with a given thickness. The formation of the resinous insulator 70 is achieved by pouring the thermosetting resin into the holder casing 10 from the upper opening 11, so that the cavity of the hemispherical head 82*a* is filled with the thermosetting resin fully. This results in an increase in contact area of the resinous insulator 70 with the high-voltage connector terminal 80, which minimizes positional misalignment of the high-voltage connector terminal 80. The formation of the high-voltage connector terminal 80 is also achieved easily by plastically deforming or pressing a plate because the hemispherical head 82*a* is simply rounded.

Figure 5:
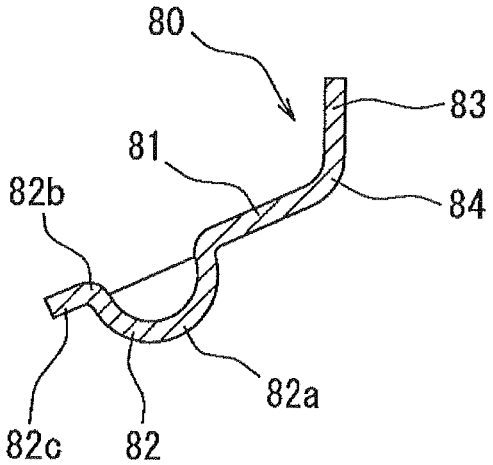
FIG. 5 is a sectional view which illustrates a high-voltage connector terminal according to the second embodiment.

FIG. 5 illustrates the high-voltage connector terminal 80 of the second embodiment. The hemispherical head 82*a* of the tip portion 82 ha a flange 82*c* extending from a portion or the whole of a circumferential edge 82*b* which does not directly connect with the arm portion 81. The flange 82*c* may be formed using a flange remaining on the tip portion 82 after a plate is plastically deformed or extruded to make the high-voltage connector terminal 80. It is preferable that the flange 82*c* is geometrically shaped or formed to occupy a portion of the circumference of the hemispherical head 82*a* so as not to touch the upper end surface 91 of the high-voltage output terminal 90 earlier than the outer surface of the hemispherical head 82*a*.

Figure 6A:
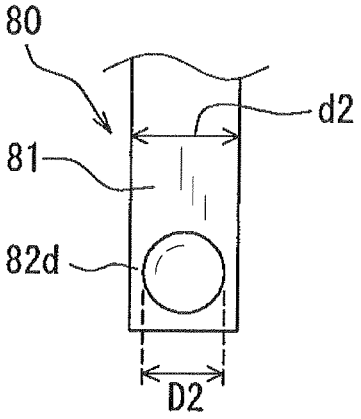
FIG. 6(*a*) is a partially plan view which illustrates a high-voltage connector terminal of the third embodiment.
Figure 6B:
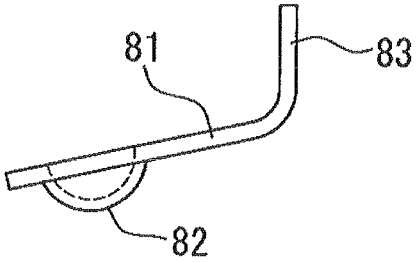

FIGS. 6(*a*) and 6(*b*) illustrate the high-voltage connector terminal 80 of the third embodiment. The high-voltage connector terminal 80 is so shaped that the width d2 of the arm portion 81 is greater than the maximum diameter D2 of the hemispherical head 82*a*. The hemispherical head 82*a* has, as clearly illustrated in FIG. 6(*a*), a rectangular flange 82*d* formed therearound. The width of the top end portion 82 is identical with the width d2 of the arm portion 83. It is, like in the second embodiment, preferable that the flange 82*d* is geometrically shaped so as not to touch the upper end surface 91 of the high-voltage output terminal 90 earlier than the outer surface of the hemispherical head 82*a*. The structure of the high-voltage connector terminal 80 also minimizes the damage to the high-voltage connector terminal 80 and the high-voltage output terminal 90 when the electric contact therebetween is made.

Figure 7A:
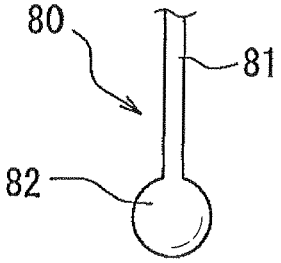
FIG. 7(*a*) is a partially plan view which illustrates a high-voltage connector terminal of the fourth embodiment.
Figure 7B:
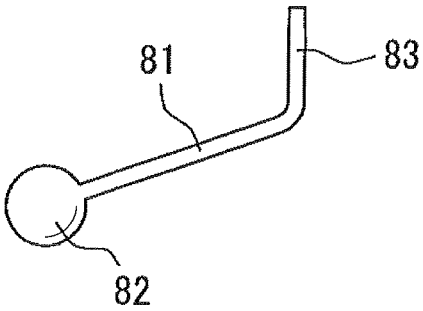

FIGS. 7(*a*) and 7(*b*) illustrate the high-voltage connector terminal 80 of the fourth embodiment. The tip portion 82 of the high-voltage connector terminal 80 is, as can be seen in the drawing, shaped to be spherical. The arm portion 81 is made in the shape of a bar. The tip portion 82, like in the above embodiments, has a rounded outer surface to be placed in contact with the upper end surface 91 of the high-voltage output terminal 90, thus minimizing the damage to the high-voltage connector terminal 80 and the high-voltage output terminal 90 when the electric contact therebetween is made.

Modifications

Figure 8A:
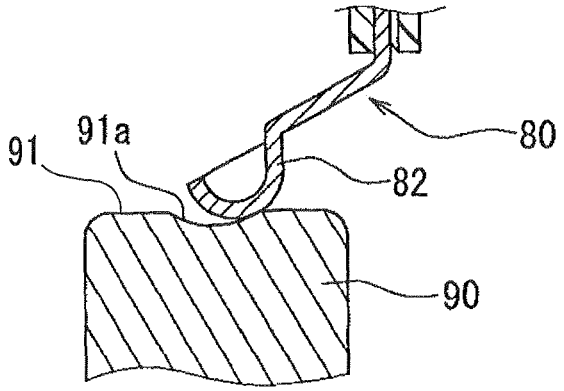
FIG. 8(*a*) is a partially sectional view which illustrates a modified form of a combination of a high-voltage connector terminal and a high-voltage output terminal.
Figure 8B:
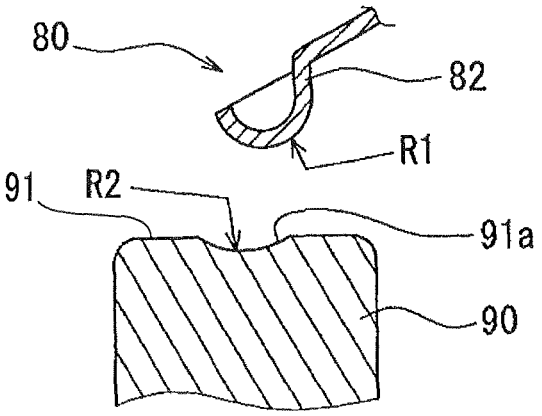

The high-voltage output terminal 90 may be, as illustrated in FIG. 8(*a*), designed to have a rounded or domed recess 91*a* with which the tip portion 82 of the high-voltage connector terminal 80 is to be placed in contact. In other words, the electrical contact is made between the rounded surfaces of the high-voltage connector terminal 80 and the high-voltage output terminal 90. This further minimizes the damage to the high-voltage connector terminal 80 and the high-voltage output terminal 90 and the adhesion of foreign objects to the tip portion 82 and the upper end surface 91. The diameter R2 of the domed recess 91*a* in the upper end surface 91 is, as illustrated in FIG. 8(*b*), preferably greater than or equal to the diameter R1 of the tip portion 82 of the high-voltage connector terminal 80 (i.e., an outer diameter of the hemispherical head 82*a*). This achieves smooth contact between the rounded outer surface of the tip portion 82 of the high-voltage connector terminal 80 and the domed recess 91*a* in the upper end surface 91 of the high-voltage output terminal 90 when the coil unit 1 is put in the holder casing 10, and the tip portion 82 slides on the upper end surface 91 in the radial direction of the high-voltage output terminal 90, thus enhancing the reliability of electrical contact between the high-voltage connector terminal 80 and the high-voltage output terminal 90.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

The tip portion 82 of the high-voltage connector terminal 80 of the first embodiment is hemispherical, but may be shaped to have a curved or rounded surface to be placed in direct contact with the upper end surface 91 of the high-voltage output terminal 90. For example, approximately one-fourth of the surface of the tip portion 82 that is an outer area of the tip portion 92 may be rounded, which will continue to contact with the upper end surface 91 of the high-voltage output terminal 90 for a period of time between when the coil unit 1 is put in the holder casing 10, and when the tip portion 82 first touches the top end surface 91 and when the tip portion 82 finishes sliding on the top end surface 9. Alternatively, more than half the outer surface of the tip portion 82 may be rounded or spherical.

In the first embodiment, the coil unit 1 is put in the holder casing 10 from the upper opening 11, but may alternatively be disposed inside the holder casing 10 from the side thereof before the plug shell 14 is attached to the holder casing 10.

Specifically, the coil unit 1 is put in the holder casing 10. The tip portion 82 of the high-voltage connector terminal 80 then touches the upper end surface 91 of the high-voltage output terminal 90. The coil unit 1 is pushed deeply in the holder casing 10, so that the rounded outer surface of the tip portion 82 smoothly slides on the upper end surface 91. The connecting portion 84 of the high-voltage connector terminal 80 is bent to right angles, as illustrated in FIG. 1, to make an electric communication between the high-voltage connector terminal 80 and the high-voltage output terminal 90 without exerting uneven pressure on the high-voltage connector terminal 80 in the radial direction of the high-voltage output terminal 90.

What is claimed is:

1. An ignition coil for an internal combustion engine comprising:

a coil unit equipped with a primary coil, a secondary coil which works to develop a high voltage as a function of an electric current flowing in the primary coil, and a high-voltage connector terminal which electrically connects with the secondary coil and is elastically deformable;

a high-voltage output terminal placed in contact with the high-voltage connector terminal for applying the high voltage, as developed by the secondary coil, to a spark plug installed in an internal combustion engine;

a holder casing in which the coil unit is disposed, the holder casing having a portion of the high-voltage output terminal exposed to atmosphere;

a resinous insulator disposed in the holder casing to cover and fix the coil unit within the holder casing, and a bobbin around which the secondary coil of the coil unit is wound and which has a first bobbin fixing portion and a second bobbin fixing portion, wherein the high-voltage connector terminal has a first end and a second end opposite the first end, the high-voltage connector terminal including a connecting portion which electrically connects at the first end with the secondary coil, a tip portion which is placed at the second end in contact with the high-voltage output terminal, and an arm portion which connects the connecting portion and the tip portion together, wherein the tip portion has a spherical surface which is placed in contact with the high-voltage output terminal and which is part of a cup-shape that faces the high-voltage output terminal, and the high-voltage connector terminal is secured to the coil unit with the connecting portion of the high-voltage connector terminal being grasped by the first bobbin fixing portion and the second bobbin fixing portion, the connecting portion extending into between the first bobbin fixing portion and the second bobbin fixing portion in a direction that is perpendicular to a surface of the high-voltage output terminal that contacts the high-voltage connector terminal.

2. An ignition coil as set forth in claim 1, wherein the tip portion of the high-voltage connector terminal includes a hemispherical head whose outer surface defines the spherical surface placed in contact with the high-voltage output terminal.

3. An ignition coil as set forth in claim 2, wherein the hemispherical head has a recess formed in a surface thereof facing in a direction opposite the high-voltage output terminal, so that the hemispherical head is the cup shape with a given thickness.

4. An ignition coil as set forth in claim 2, wherein the arm portion of the high-voltage connector terminal is made in the shape of a plate, and wherein a maximum diameter of the hemispherical head is greater than a width of the arm portion.

5. An ignition coil as set forth in claim 1, wherein the tip portion has a cavity facing in a direction away from the high-voltage output terminal.

6. An ignition coil as set forth in claim 5, wherein the cavity is defined by a bowl-shaped recess.

7. An ignition coil as set forth in claim 1, wherein the spherical surface occupies approximately one-fourth of an outer area of a surface of the tip portion.

8. An ignition coil as set forth in claim 1, wherein the spherical surface prevents uneven pressure from being exerted on the high-voltage connector terminal in a radial direction of the high-voltage output terminal.

* * * * *